US005939685A

United States Patent [19]

Matsuhashi

[11] Patent Number: 5,939,685

[45] Date of Patent: Aug. 17, 1999

[54] STOPPING DEVICE WITH A SWITCH

[75] Inventor: Akira Matsuhashi, Tachikawa, Japan

[73] Assignee: Metrol Co., Ltd., Tachikawa, Japan

[21] Appl. No.: 09/136,607

[22] Filed: Aug. 20, 1998

[51] Int. Cl.[6] ..... H01H 3/16

[52] U.S. Cl. ..... 200/61.41; 200/302.1

[58] Field of Search ..... 33/201, 202, 549, 33/552, 556–561, 572; 73/104, 865.8, 866.5; 200/61.2, 61.21, 61.41, 61.42, 61.62, 61.67, 61.76, 61.78, 85 R, 17 R, 52 R, 47, 302.1, 302.2, 334

[56] References Cited

U.S. PATENT DOCUMENTS

| | | | |
|---|---|---|---|
| 2,822,436 | 2/1958 | Towle | 200/61.41 |
| 4,496,807 | 1/1985 | Sakata | 200/61.42 |
| 4,788,517 | 11/1988 | Meister | 335/205 |
| 4,910,366 | 3/1990 | Matsumoto et al. | 200/61.89 |
| 5,412,168 | 5/1995 | McKelvey et al. | 200/61.41 |

*Primary Examiner*—Michael Friedhofer
*Attorney, Agent, or Firm*—Kanesaka & Takeuchi

[57] ABSTRACT

A stopping device with a switch is used for stopping an object to be detected, such as a table on which a work or material to be measured is mounted. The stopping device is basically formed of a housing; a first leaf spring disposed in the housing and fixed thereto at an outer portion; an actuating shaft with a stopping surface fixed to an inner portion of the first leaf spring to be movable inside the housing; a movable contact attached to the actuating shaft at a side opposite to the stopping surface; a second leaf spring disposed in the housing to face the first leaf spring and fixed to the housing at an outer portion thereof; and a fixed contact fixed to an inner portion of the second leaf spring and facing the movable contact with a space therebetween. When the object abuts against the stopping surface, the actuating shaft is displaced to allow the movable contact to contact the fixed contact, and after the object is further displaced in a contact condition of the movable and fixed contacts, the object is stopped by the stop reference surface. The stopping device can be extremely shortened in its length.

10 Claims, 2 Drawing Sheets

STOPPING DEVICE WITH A SWITCH

BACKGROUND OF THE INVENTION AND RELATED ART STATEMENT

The present invention relates to a stopping device with a switch or stopper switch formed of, in combination, a stopping member for stopping an object to be detected at a predetermined position through abutment with the object, and a switch or a control signal generating device for outputting a signal immediately before the object is stopped.

Heretofore, it has been generally carried out that an object to be detected, such as a table on which a work or an object to be measured is mounted, is stopped at a predetermined position by abutting against a stopping member, such as a positioning bolt.

In the above case, it is required to confirm that the object to be detected abuts against the stopping member, or to switch the movement of the object in a reverse direction.

Therefore, a switch for outputting such a control signal or a dog has been provided separately from the stopping member, which takes time and labor for attaching the same and requires an additional space therefor. Further, it has been troublesome to adjust an operating position of the switch.

In order to solve the above problems, the present inventor has invented stopping devices with a switch as disclosed in Japanese Patent Publications (KOKAI) No. 7-237544 and No. 8-355529.

In the stopping devices as disclosed in the above applications, since a shaft sliding in a direction perpendicular to a stopping surface is required, a length of a slide shaft bearing and a length of a compressed coil spring for projecting the above slid shaft from a bolt body are added to the length of the shaft. Thus, the stopping device with the switch becomes long in the direction perpendicular to the stopping surface. Therefore, the stopping device is not suitable for a case where a short stopping device with a switch is required.

Further, in the stopping device as disclosed in Japanese Patent Publication No. 8-355529, since plural slide shafts and slide shaft bearings have to be provided to a switching portion, these sliding portions may not operate properly.

Accordingly, an object of the invention is to provide a stopping device with a switch, wherein a length of the stopping device is shortened.

Another object of the invention is to provide a stopping device with a switch as stated above, wherein sliding portions are substantially eliminated so that the stopping device has no friction and troubles caused by the friction are reduced.

A further object of the invention is to provide a stopping device with a switch as stated above, wherein a sufficient waterproofing property is obtained.

Further objects and advantages of the invention will be apparent from the following description of the invention.

SUMMARY OF THE INVENTION

In order to solve the above problems, a stopping device with a switch of a first aspect of the invention includes a housing having a stop reference surface at an edge surface thereof for stopping an object to be detected; at least one first leaf spring disposed in the housing and attached to the housing at an outer portion so that the leaf spring is disposed parallel to the stop reference surface; an actuating shaft fixed to an inner portion of the first leaf spring so that the actuating shaft is located perpendicular to the same, and having a stopping surface projected from the reference stopping surface and a movable contact at an edge opposite to the stopping surface; at least one second leaf spring situated in the housing and fixed thereto at an outer portion thereof; a fixed contact fixed to an inner portion of the second leaf spring and disposed with a space to the movable contact; and a sealing or waterproofing device provided between an inner surface on a side opposite to the stop reference surface of the housing and the actuating shaft.

While the object abuts against the stopping surface and is displaced together with the stopping surface, the movable contact comes into contact with the fixed contact, and then the object abuts against the stop reference surface. As a result, the object is stopped at the stop reference surface.

Also, a stopping device with a switch of a second aspect of the invention includes a housing having a stop reference surface at a side surface thereof for stopping an object to be detected; at least one first leaf spring situated inside the housing and fixed thereto at an outer portion thereof so that the leaf spring is disposed parallel to the stop reference surface; an actuating shaft fixed to an inner portion of the first leaf spring and arranged perpendicular thereto, the actuating shaft having a first stopping surface projected from the reference stopping surface, a second stopping surface on a side opposite to the first stopping surface parallel to the reference stopping surface with a predetermined distance therefrom, and a movable contact at a side opposite to the first stopping surface; at least one second leaf spring situated in the housing at a position opposite to the first leaf spring, and fixed to the housing at an outer portion thereof; a fixed contact fixed to an inner portion of the second leaf spring opposite to the movable contact with a space therefrom; and a sealing or waterproofing device formed of a rubber provided between an edge of the housing and the actuating shaft so that the waterproofing device covers the stop reference surface and the second stopping surface.

While the object abuts against the first stopping surface and is displaced together with the actuating shaft, the movable contact comes into contact with the fixed contact to thereby conduct electricity. Then, the second stopping surface abuts against the stop reference surface. As a result, the object is stopped.

DETAILED DESCRIPTION OF PREFERRED EMBODIMENTS

Figure 1:
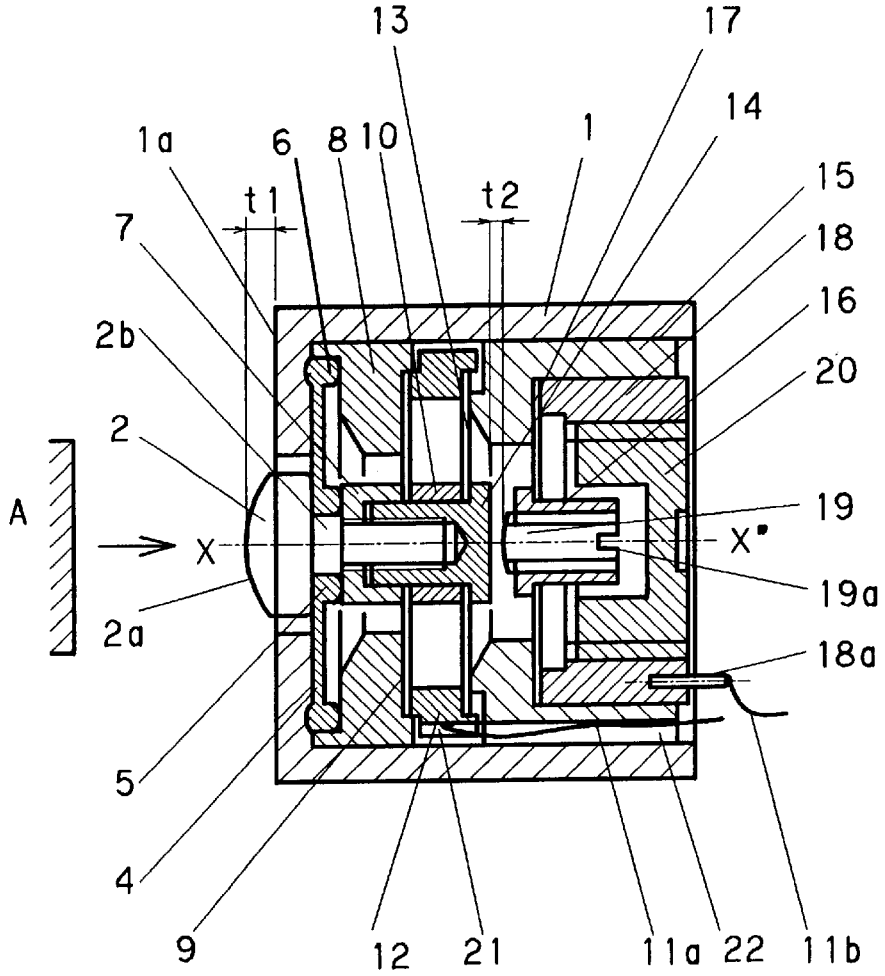
FIG. 1 is a sectional view cut at a center of an embodiment of a stopping device with a switch of the present invention.
Figure 2:
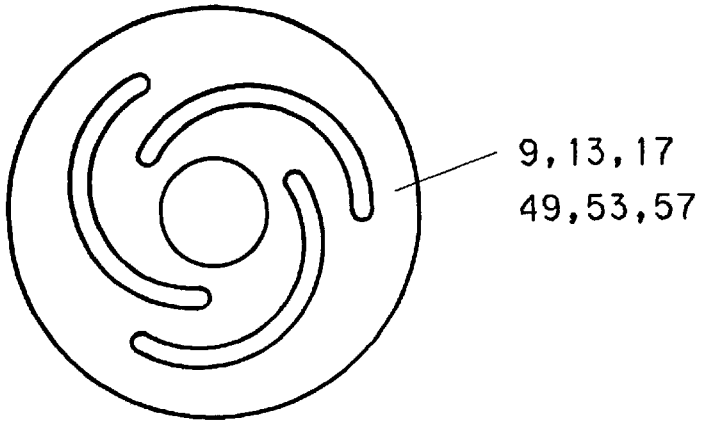
FIG. 2 is a front view of a leaf spring used in the stopping device.

Referring to FIGS. 1 and 2, an embodiment of a stopping device with a switch of the invention is described hereunder.

In FIG. 1, reference numeral 1 represents a housing, 1*a* is a reference stopping surface or stop reference surface, and 2 is an actuating shaft. A left-edge surface 2*a* of the actuating shaft 2 constitutes a stopping surface.

The actuating shaft 2 is provided with a step portion 2*b*, on which a diaphragm 4 made of a rubber material and having annular projections 5, 6 is situated. Disposed on the actuating shaft 2 are a first intermediate cylinder 7; a first intermediate ring 8 made of an insulating material; a first or front leaf spring 9 (refer to FIG. 2); a second intermediate cylinder 10; a second intermediate ring 12 with a lead wire 11*a* soldered thereon; and a second or rear leaf spring 13 (refer to FIG. 2). The actuating shaft 2 with the above members is tightened by a movable contact 14 in the form of a nut. After the above members are assembled, the actuating shaft 2 is housed in an inner portion of the housing 1.

Further, a third intermediate ring 15 made of an insulating material is fitted into the inner portion of the housing 1 such that an end portion faces the reference stopping surface 1*a*. The third intermediate ring 15 inserted into the housing 1 is bonded thereto.

Grooves 21, 22 extending in an X–X" direction, i.e. axial direction are provided in portions of outer circumferences of the second intermediate ring 12 and the third intermediate ring 15, and the lead wire 11*a* passes therethrough.

A third leaf spring 17 (refer to FIG. 2) is fixed at an inner periphery thereof to a flange of a nut 16, which is inserted into an inner circumference of the third intermediate ring 15. Then, a fourth intermediate ring 18 made of an electroconductive material is pressed into the third intermediate ring 15 and is bonded thereto.

An electroconductive pin 18*a* is planted or disposed in a right edge of the fourth intermediate ring 18, and a lead wire 11*b* is soldered thereto.

A fixed contact 19 in a screw shape is screwed into the nut 16 with the flange, and a cover 20 for the fixed contact 19 is screwed into an inner circumference of the fourth intermediate ring 18.

Assuming that a projecting length of a stopping surface 2*a* of the actuating shaft 2 from the reference stopping surface 1*a* is t1 and a space between the movable contact 14 and the fixed contact 19 is t2, an adjustment is made by rotating the fixed contact 19 at a sliding slit 19*a* so that t1>t2 is held.

Next, an operation of the invention is explained. In the state of the stopping device with the switch as shown in FIG. 1, in case the object A to be detected is moved in a right-hand direction, i.e. an arrow direction, the object A abuts against the stopping surface 2*a* of the actuating shaft 2. Then, the actuating shaft 2 is further pushed by the object A in the right-hand direction while the first and second leaf springs 9, 13 are being bent, and the movable contact 14 positioned at the right edge of the actuating shaft 2 contacts the fixed contact 19.

As the actuating shaft 2 is further displaced together with the object A in the right-hand direction, the movable contact 14 in contact with the fixed contact 19 is further displaced in the right-hand direction while the third leaf spring 17 is being bent. Then, the object A abuts against the reference stopping surface 1*a* of the housing 1 and stops.

Through the contact of the movable contact 14 with the fixed contact 19 as mentioned above, there is formed a circuit including the lead wire 11*a*, second intermediate ring 12, first and second leaf springs 9, 13, second intermediate cylinder 10, movable contact 14, fixed contact 19, nut with the flange 16, third leaf spring 17, fourth intermediate ring 18, electroconductive pin 18*a* and lead wire 11*b* to send an "ON" signal to a control circuit, not shown. Thus, it is confirmed that the object A abuts against the stopping member, or a moving direction of the object A is reversed.

Figure 3:
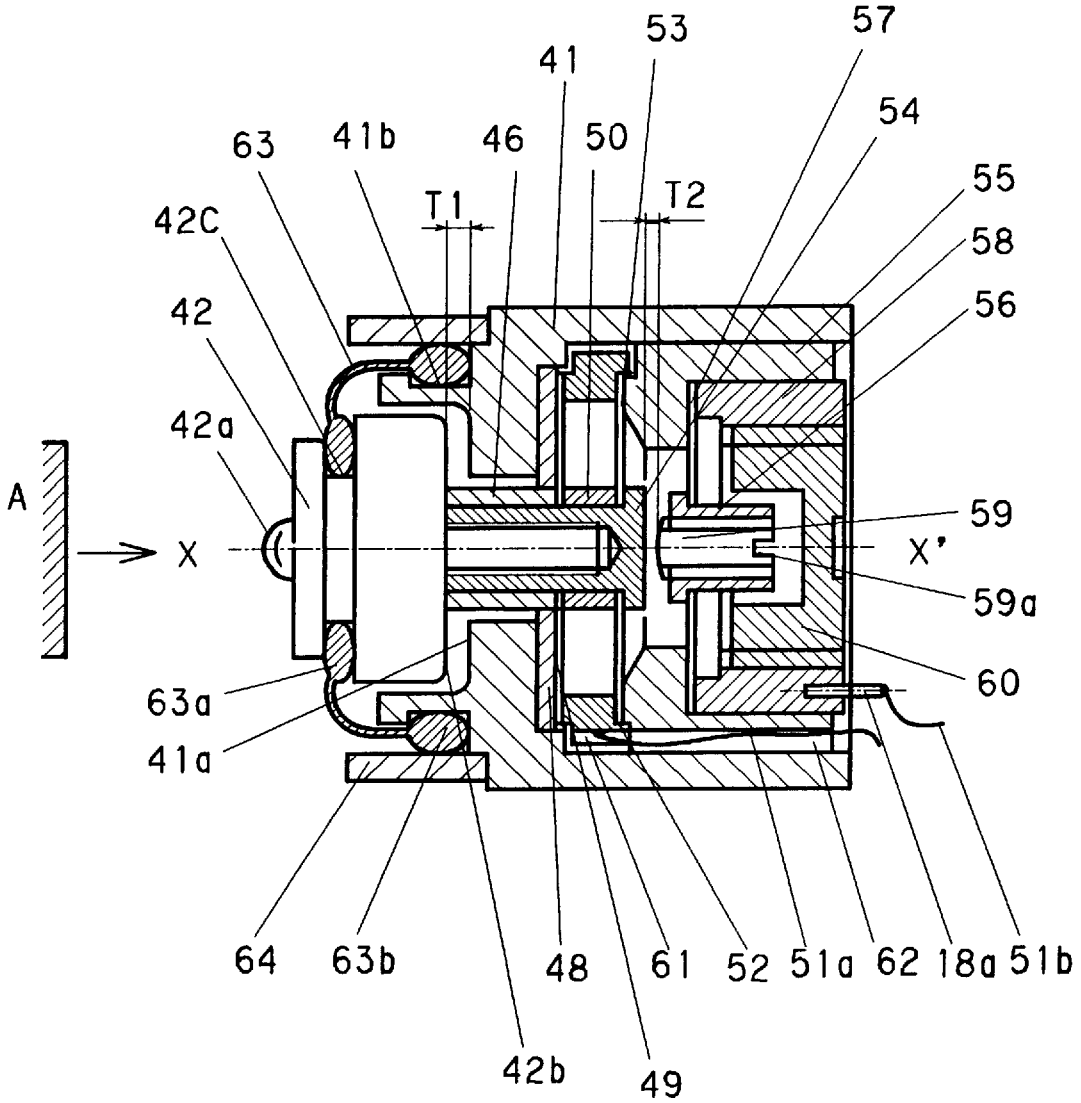
FIG. 3 is a sectional view cut at a center of another embodiment of a stopping device with a switch of the present invention.

FIG. 3 is a sectional view cut at a center of another embodiment of a stopping device with a switch of the invention, wherein reference numeral 41 is a housing; 41*a* is a reference stopping surface; and 42 is an actuating shaft. A left end surface 42*a* of the actuating shaft constitutes a first stopping surface, and a surface 42*b* opposed thereto and parallel to the reference stopping surface 41*a* of the housing 41 constitutes a second stopping surface.

Disposed on the actuating shaft 42 are a first intermediate cylinder 46, a first or front leaf spring 49 (refer to FIG. 2), a second intermediate cylinder 50, a second intermediate ring 52 with a lead wire 51*a* soldered thereto and a second or rear leaf spring 53 (refer to FIG. 2). A movable contact 54 in a nut shape is fixed onto the actuating shaft 42. The actuating shaft 42 thus assembled is located in an inner portion of the housing 41 through a first insulating intermediate ring 48 in a washer shape.

The intermediate cylinders 46, 50, the leaf springs 49, 53 and the insulating intermediate ring 48 may be assembled on the movable contact 54 and placed in the housing 41. Then, the actuating shaft 42 may be engaged with the movable contact 54.

Then, a third intermediate ring 55 made of an insulating material is fitted into the inner periphery of the housing 41 in a state that an end portion thereof faces the reference stopping surface 41*a*. The third intermediate ring 55 is bonded to the inner periphery of the housing 41.

Grooves 61, 62 in an X–X' direction are formed on portions of the outer circumferences of the second intermediate ring 52 and the third intermediate ring 55, respectively. A lead wire 51*a* passes through the grooves 61, 62.

A third leaf spring 57 (Refer to FIG. 2) is fixed at an inner periphery thereof to a flange of a nut 56, and is inserted into an inner circumference of the third intermediate ring 55. Also, a fourth intermediate ring 58 made of an electric conductive material is placed inside the third intermediate ring 55 and is bonded thereto.

The fourth intermediate ring 58 is provided with a conductive pin 58*a* at a right end, and a lead wire 51*b* is soldered thereto.

A fixed contact 59 in a screw shape is screwed into the nut 56 with the flange, and a cover 60 for the fixed contact 59 is screwed into an inner circumference of the fourth intermediate ring 58.

The actuating shaft 42 is provided with a groove 42*c* on the left side thereof. A round portion 63*a* at one end of a rubber cover 63 is tightly fitted thereinto, and a round portion 63*b* at the other end of the rubber cover 63 is received in a groove 41*b* provided on a flange of the housing 41. When a dust cover 64 is fitted to the housing 41, the round portion 63*b* is pressed into the groove 41*b*.

Assuming that a distance between the reference stopping surface 41*a* and the second stopping surface 42*b* of the actuating shaft 42 is represented by T1, and a distance between the movable contact 54 and the fixed contact 59 is represented by T2, the fixed contact 59 is adjusted to hold a condition of T1>T2.

Next, an operation of the stopping device with the switch is explained. In a state as shown in FIG. 3, the object A to be detected is moved in a right-hand direction, i.e. arrow direction, to abut against the first stopping surface 42*a* of the actuating shaft 42. When the actuating shaft 42 is pushed by the object A and displaced in the right-hand direction while bending the first leaf spring 49 and the second leaf spring 53, the movable contact 54 provided at the right edge of the actuating shaft 42 contacts the fixed contact 59.

In case the actuating shaft 42 is further pushed by the object A in the right-hand direction, it is displaced toward the right-hand direction while keeping the contact condition of the movable contact 54 and the fixed contact 59 and bending the second leaf spring 57. Then, the second stopping surface 42*b* abuts against the reference stopping surface 41*a* of the housing 41 to thereby stop the object A.

Through the contact of the movable contact 54 and the fixed contact 59 as described above, a circuit including the lead wire 51*a*, second intermediate ring 52, first and second leaf springs 49, 53, second intermediate cylinder 50, movable contact 54, fixed contact 59, nut 56 with the flange, third leaf spring 57, fourth intermediate ring 58, conductive pin 58*a* and lead wire 51*b*, is formed to send an "ON" signal to a control circuit, not shown. As a result, it is confirmed that the object A abuts against the stopping member, or a moving direction of the object A is reversed.

In the embodiments as shown in FIGS. 1 and 3, although the leaf springs are formed of two, i.e. first and second, leaf springs, it may be formed of one or more than three leaf springs, or the third leaf spring may be formed of a plurality of leaf springs.

In the invention, since the leaf springs are used, the stopping device with a switch can be formed of short length as compared with a conventional device with the switch having a sliding shaft and a compressed coil spring.

In the invention, since the diaphragm or rubber cover is installed on the shaft, necessary waterproofing property can be obtained.

In the invention, further, since the stopping device with a switch has a structure without friction, there are few troubles.

While the invention has been explained with reference to the specific embodiments of the invention, the explanation is illustrative, and the invention is limited only by the appended claims.

What is claimed is:

1. A stopping device with a switch, comprising:

a housing having a stop reference surface at one side and an inner space;

a first leaf spring disposed in the inner space of the housing and having inner and outer portions, said outer portion of the first leaf spring being fixed to the housing;

an actuating shaft fixed to the inner portion of the first leaf spring and being movable inside the housing perpendicular to the stop reference surface, said actuating shaft having a stopping surface at one side to project outwardly from the stop reference surface;

a movable contact attached to the actuating shaft at a side opposite to the stopping surface;

a sealing device disposed between the actuating shaft and the housing for sealing therebetween;

a second leaf spring disposed in the inner space of the housing to face the first leaf spring and having inner and outer portions, said outer portion of the second leaf spring being fixed to the housing; and a fixed contact attached to the inner portion of the second leaf spring and being movable inside the housing, said fixed contact facing the movable contact with a space therebetween so that when an object abuts against the stopping surface, the actuating shaft is displaced to allow the movable contact to contact the fixed contact, and after the object is further displaced in a contact condition of the movable and fixed contacts, the object is stopped by the stop reference surface.

2. A stopping device with a switch according to claim 1, wherein said first leaf spring is arranged substantially parallel to the stop reference surface, and the actuating shaft is fixed to the inner portion of the first leaf spring perpendicular thereto, said object directly abutting against the stop reference surface and being stopped after the object is displaced in the contact condition of the movable and fixed contacts.

3. A stopping device with a switch according to claim 1, wherein said first leaf spring is formed of two leaf springs situated parallel to each other so that the actuating shaft is held stably.

4. A stopping device with a switch according to claim 3, further comprising a first ring situated near one of the two leaf springs, a second ring situated between the two leaf springs, a third ring situated between the other of the two leaf springs and the second leaf spring, and a fourth ring for holding the second leaf spring together with the third ring.

5. A stopping device with a switch according to claim 4, further comprising a first cylinder situated on the actuating shaft and contacting said one of the two leaf springs, and a second cylinder situated on the actuating shaft and disposed between the two leaf springs, said movable contact having a flange so that the other of the two leaf springs being held between the flange and the second cylinder.

6. A stopping device with a switch according to claim 5, further comprising a first lead connected to the second ring to conduct to the movable contact through the two leaf springs, and a second lead connected to the fourth ring to conduct to the fixed contact through the second leaf spring.

7. A stopping device with a switch according to claim 6, wherein said sealing device is situated inside the housing and is arranged substantially parallel to said two leaf springs between the stop reference surface and the first ring.

8. A stopping device with a switch according to claim 6, wherein said actuating shaft includes a head portion having said stopping surface at one side, a second stopping surface at a side opposite to the stopping surface and facing the stop reference surface and a first groove situated between the stopping surface and the second stopping surface, and a shaft portion extending from the head portion.

9. A stopping device with a switch according to claim 8, wherein said housing includes a flange extending axially outwardly from the stop reference surface to partly surround the head portion and having an outer groove, one side of the sealing device being located in the first groove and an other side of the sealing device being located in the outer groove.

10. A stopping device with a switch according to claim 9, further comprising a dust cover situated outside the flange of the housing to hold the other side of the sealing device.

* * * * *